US011266179B2

(12) United States Patent
Peirce et al.

(10) Patent No.: US 11,266,179 B2
(45) **Date of Patent: *Mar. 8, 2022**

(54) JOINT SMOKING DEVICE WITH PLUNGER OR AUGER

(71) Applicant: Gravitron, LLC, Austin, TX (US)

(72) Inventors: Stephan Peirce, Austin, TX (US); Micah Evans, Austin, TX (US); Travis Dodson, Austin, TX (US)

(73) Assignee: Gravitron, LLC, Austin, TX (US)

( * ) Notice: Subject to any disclaimer, the term of this patent is extended or adjusted under 35 U.S.C. 154(b) by 420 days.

This patent is subject to a terminal disclaimer.

(21) Appl. No.: 16/271,161

(22) Filed: Feb. 8, 2019

(65) Prior Publication Data

US 2020/0253271 A1 Aug. 13, 2020

(51) Int. Cl.

| | |
|---|---|
| ***A24F 1/28*** | (2006.01) |
| ***A24F 1/32*** | (2006.01) |
| ***A24F 9/02*** | (2006.01) |
| ***A24F 7/00*** | (2006.01) |

(52) U.S. Cl.

CPC ..... *A24F 1/28* (2013.01); *A24F 1/32* (2013.01); *A24F 7/00* (2013.01); *A24F 9/02* (2013.01)

(58) Field of Classification Search

None

See application file for complete search history.

(56) References Cited

U.S. PATENT DOCUMENTS 136,487 A 3/1873 Buynitzky
1,257,905 A * 2/1918 Mack ..... A24F 13/10 131/182
2,355,368 A * 8/1944 Di Rubbio ..... A24F 13/14 131/182
3,552,454 A 1/1971 Demming
4,058,129 A * 11/1977 Beringer ..... A24B 15/12 131/375

(Continued)

FOREIGN PATENT DOCUMENTS

DE 4338884 C1 3/1995

OTHER PUBLICATIONS

WeedList NPL (https://web.archive.org/web/20150120070255/http://www.weedist.com/image-post/first-impressions-fourhitter-pipe/) (Year: 2014).*

(Continued)

*Primary Examiner* — Francisco W Tschen

*Assistant Examiner* — Guy F Mongelli

(74) *Attorney, Agent, or Firm* — Dickinson Wright, PLLC; Michael E. Noe, Jr.

(57) ABSTRACT

An apparatus for smoking combustible material can include a glass tube having an axis and open ends. The apparatus can have a rod axially coupled to the glass tube. In addition, a grommet formed from an elastic material can be included. Examples of the grommet can have a tube end to axially receive the glass tube in an interior of the grommet. A shoulder can be located in the interior of the grommet to abut one of the open ends of the glass tube. The grommet can further include a rod end to receive and frictionally engage a portion of the rod and permit relative motion between the rod and the grommet. In addition, the grommet can have an external annular recess located between the tube end and the rod end.

19 Claims, 10 Drawing Sheets

(56) References Cited

U.S. PATENT DOCUMENTS

| | | | | |
|---|---|---|---|---|
| 4,827,827 | A | 5/1989 | Sanfilippo | |
| 4,877,067 | A | 10/1989 | Shimokawa et al. | |
| 4,884,602 | A | 12/1989 | Yamamoto et al. | |
| 4,972,886 | A | 11/1990 | Bernstein | |
| 5,081,822 | A | 1/1992 | Boyd et al. | |
| 5,321,932 | A | 6/1994 | Sundberg | |
| 6,182,669 | B1 * | 2/2001 | van der Elst | A24D 1/12 131/187 |
| 7,530,213 | B2 | 5/2009 | Barrett et al. | |
| 8,490,629 | B1 | 7/2013 | Shenassa et al. | |
| 8,955,563 | B2 | 2/2015 | Tahil et al. | |
| D761,487 | S | 7/2016 | Han | |
| 9,862,519 | B2 | 1/2018 | Deutschle et al. | |
| 9,968,127 | B2 | 5/2018 | Han | |
| 10,071,021 | B2 | 9/2018 | Calvert, II et al. | |
| 2001/0035431 | A1 | 11/2001 | Runft | |
| 2001/0043972 | A1 | 11/2001 | Tomlinson | |
| 2003/0215956 | A1 | 11/2003 | Reed | |
| 2004/0200493 | A1 * | 10/2004 | Matsufuji | A24C 5/1821 131/364 |
| 2005/0076969 | A1 | 4/2005 | Tahil et al. | |
| 2006/0248857 | A1 | 11/2006 | Senesi | |
| 2008/0216312 | A1 | 9/2008 | Williams et al. | |
| 2009/0288375 | A1 | 11/2009 | Pagani | |
| 2011/0259467 | A1 | 10/2011 | Maness | |
| 2013/0014471 | A1 | 1/2013 | Tahil et al. | |
| 2013/0068348 | A1 | 3/2013 | Sanchez | |
| 2014/0026904 | A1 * | 1/2014 | Monty | A24F 13/18 131/256 |
| 2015/0013704 | A1 * | 1/2015 | Maglione | A24F 1/30 131/330 |
| 2018/0134423 | A1 | 5/2018 | Narvekar et al. | |
| 2019/0000138 | A1 * | 1/2019 | Han | A24F 1/28 |
| 2019/0127102 | A1 | 5/2019 | Chudy et al. | |

OTHER PUBLICATIONS

The International Searching Authority, Notification of Transmittal of the International Search Report and the Written Opinion of the International Searching Authority.

"GravLabs Glass Blunt—First Impressions", YouTube, May 18, 2016.

"Ooze Slider Glass Blunt: Review, How to, What is, FAQ Vape Brat Review", YouTube, Mar. 10, 2017.

youtube.com, "Goldenfish Pipe: How to Pack / Load and use, what is & how to", https://www.youtube.com/watch?v=M_MmwHQMNTw, one page.

Davis, Austin G., "Pre-Packs" Word Mark, Trademark Registration No. 5,799,351 registered on Jul. 9, 2019, filed Dec. 6, 2018, two pages.

* cited by examiner

JOINT SMOKING DEVICE WITH PLUNGER OR AUGER

CROSS-REFERENCE TO RELATED APPLICATIONS

Not Applicable.

TECHNICAL FIELD

This application generally relates to smoking devices and, in particular, to a system, method and apparatus for a joint smoking device with plunger or auger.

STATEMENT OF FEDERALLY FUNDED RESEARCH

None.

BACKGROUND OF THE DISCLOSURE

Smoking devices for human consumption of combustible materials commonly include a variety of inhalation delivery devices and methods. For example, rolling papers, hand pipes, water pipes and hookahs offer popular smoking platforms. Although these designs are workable, improvements in smoking devices continue to be of interest.

SUMMARY OF THE DISCLOSURE

Embodiments of a system, method and apparatus for a smoking device are disclosed. For example, an apparatus for smoking combustible material can include a glass tube having an axis and open ends. The apparatus also can include a rod configured to be axially coupled to the glass tube. In addition, a grommet formed from an elastic material can be included. Examples of the grommet can have a tube end configured to axially receive the glass tube in an interior of the grommet. A shoulder can be located in the interior of the grommet and configured to abut one of the open ends of the glass tube. The grommet can further include a rod end configured to receive and frictionally engage a portion of the rod and permit relative motion between the rod and the grommet. In addition, the grommet can have an external annular recess located between the tube end and the rod end. In some versions, the outer diameter of the external annular recess can be greater than or equal to an inner diameter of the tube end. Moreover, the outer diameter of the external annular recess can be greater than or equal to an inner diameter of the rod end. Furthermore, the inner diameter of the tube end can be greater than the inner diameter of the rod end.

The foregoing and other objects and advantages of these embodiments will be apparent to those of ordinary skill in the art in view of the following detailed description, taken in conjunction with the appended claims and the accompanying drawings.

BRIEF DESCRIPTION OF THE DRAWINGS

For a detailed description of example embodiments, reference will now be made to the accompanying drawings in which.

DEFINITIONS

Various terms are used to refer to particular system components. Different companies may refer to a component by different names—this document does not intend to distinguish between components that differ in name but not function. In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection or through an indirect connection via other devices and connections.

DETAILED DESCRIPTION

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Figure 1:
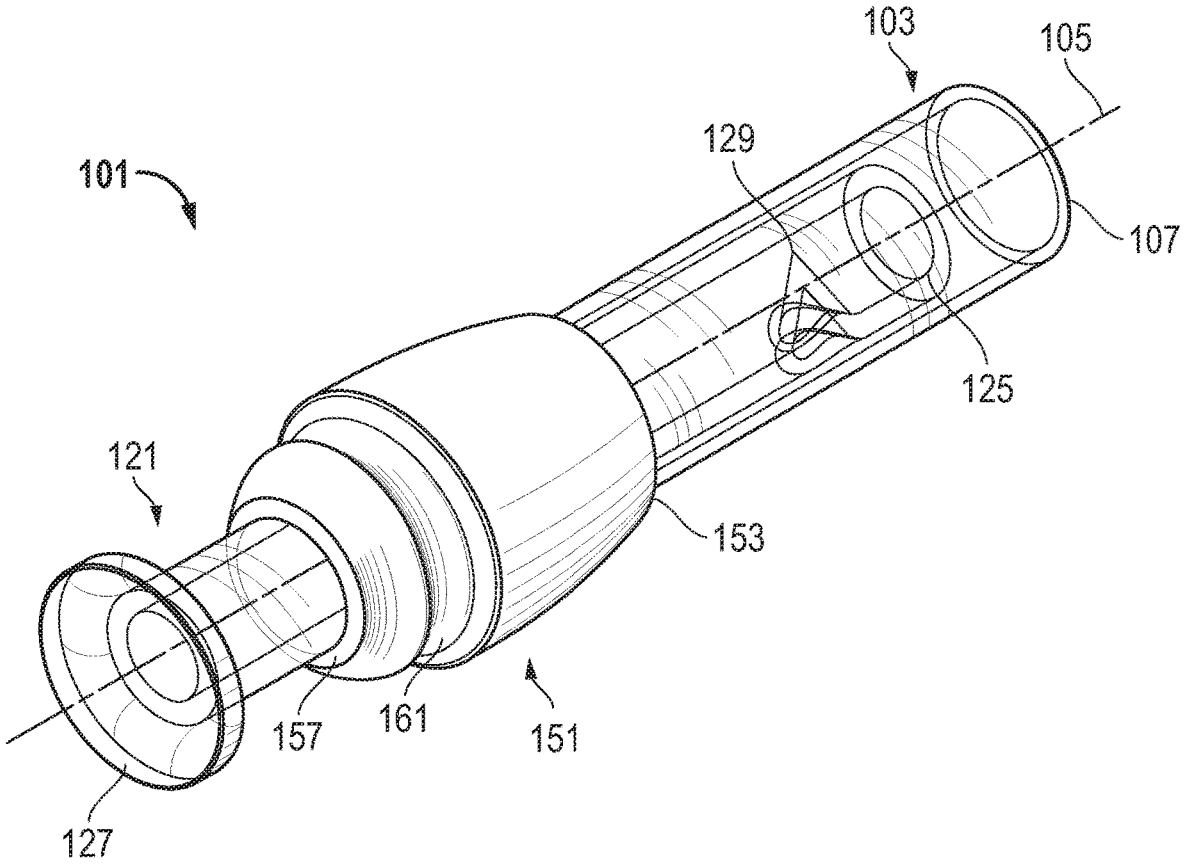
FIG. 1 is a perspective view of an embodiment of a glass joint with the plunger in an installed position.
Figure 2:
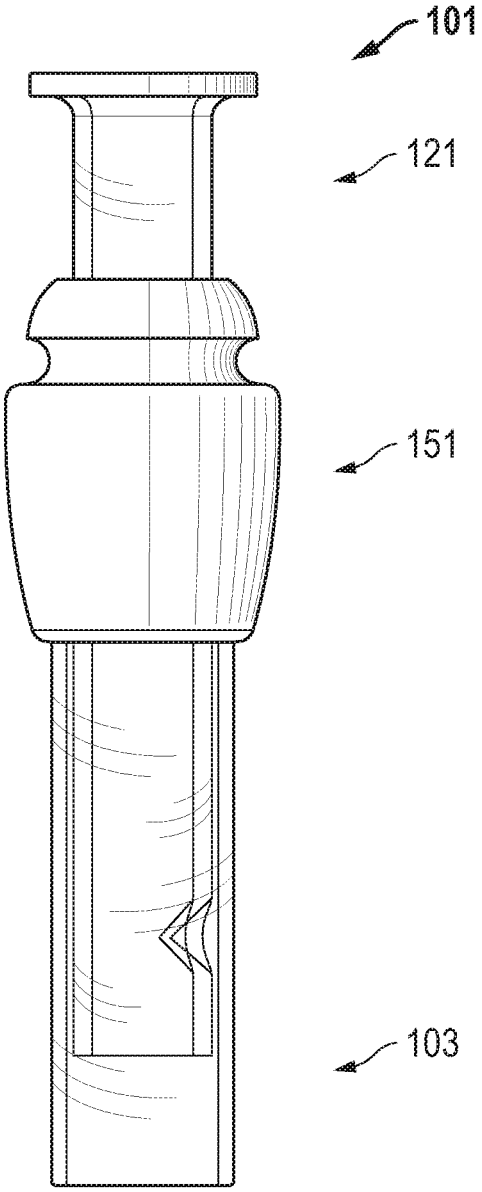
FIG. 2 is a right side view of an embodiment of the glass joint of FIG. 1.
Figure 3:
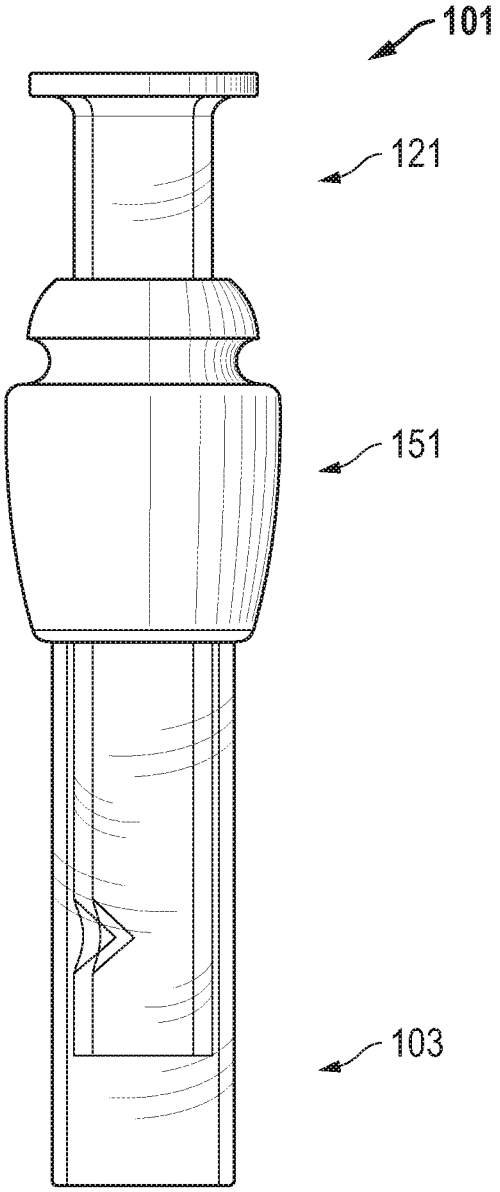
FIG. 3 is a left side view of an embodiment of the glass joint of FIG. 1.
Figure 4:
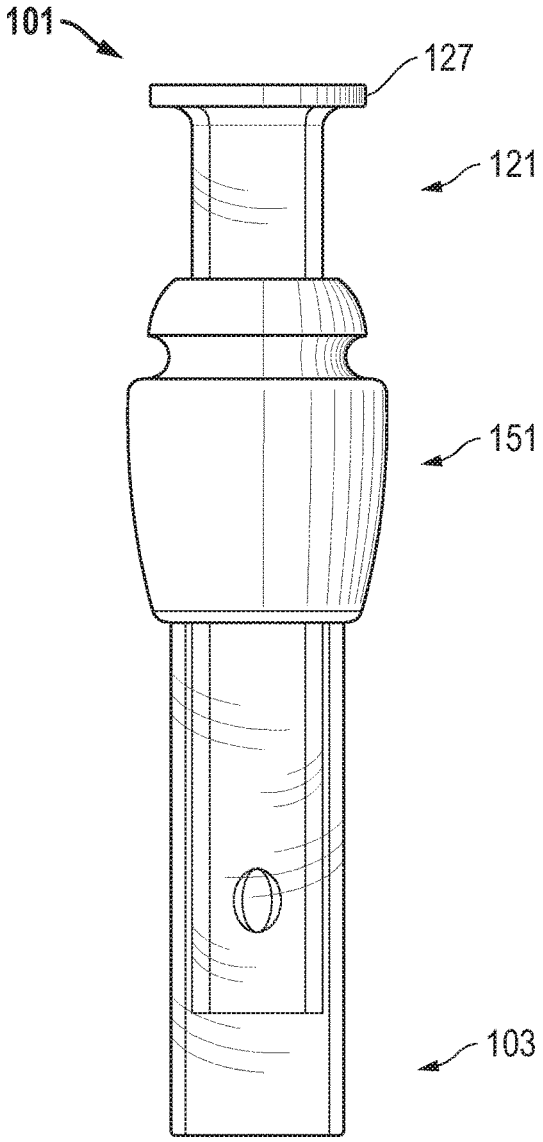
FIG. 4 is a top view of an embodiment of the glass joint of FIG. 1.
Figure 5:
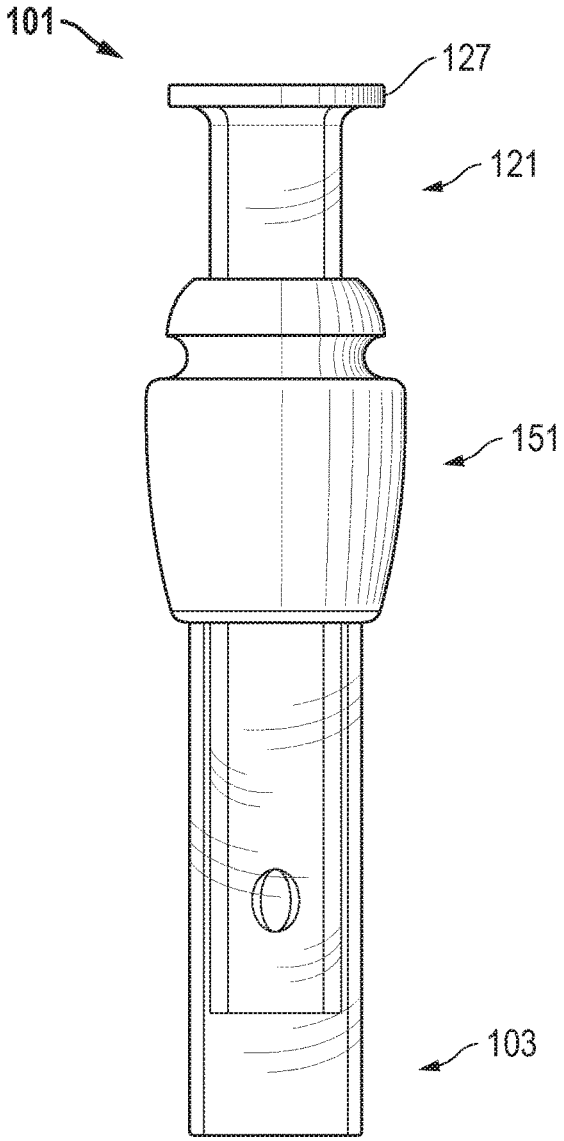
FIG. 5 is a bottom view of an embodiment of the glass joint of FIG. 1.
Figure 6:
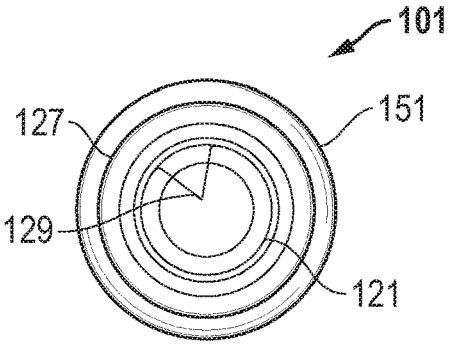
FIG. 6 is a front view of an embodiment of the glass joint of FIG. 1.
Figure 7:
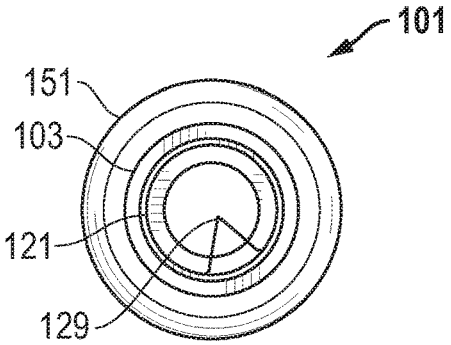
FIG. 7 is a rear view of an embodiment of the glass joint of FIG. 1.
Figure 8:
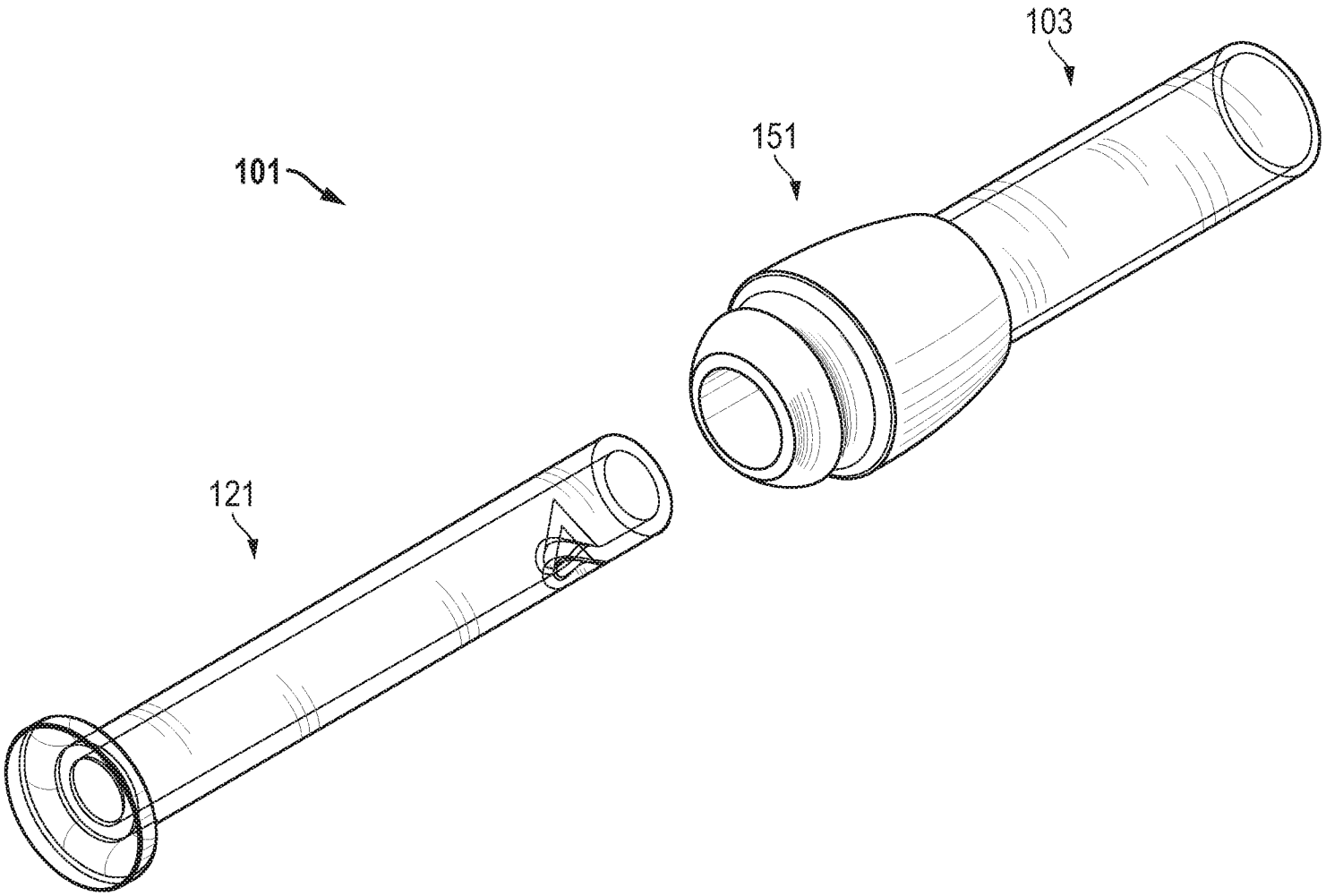
FIG. 8 is a perspective view of an embodiment of the glass joint with the plunger in a removed position.
Figure 9:
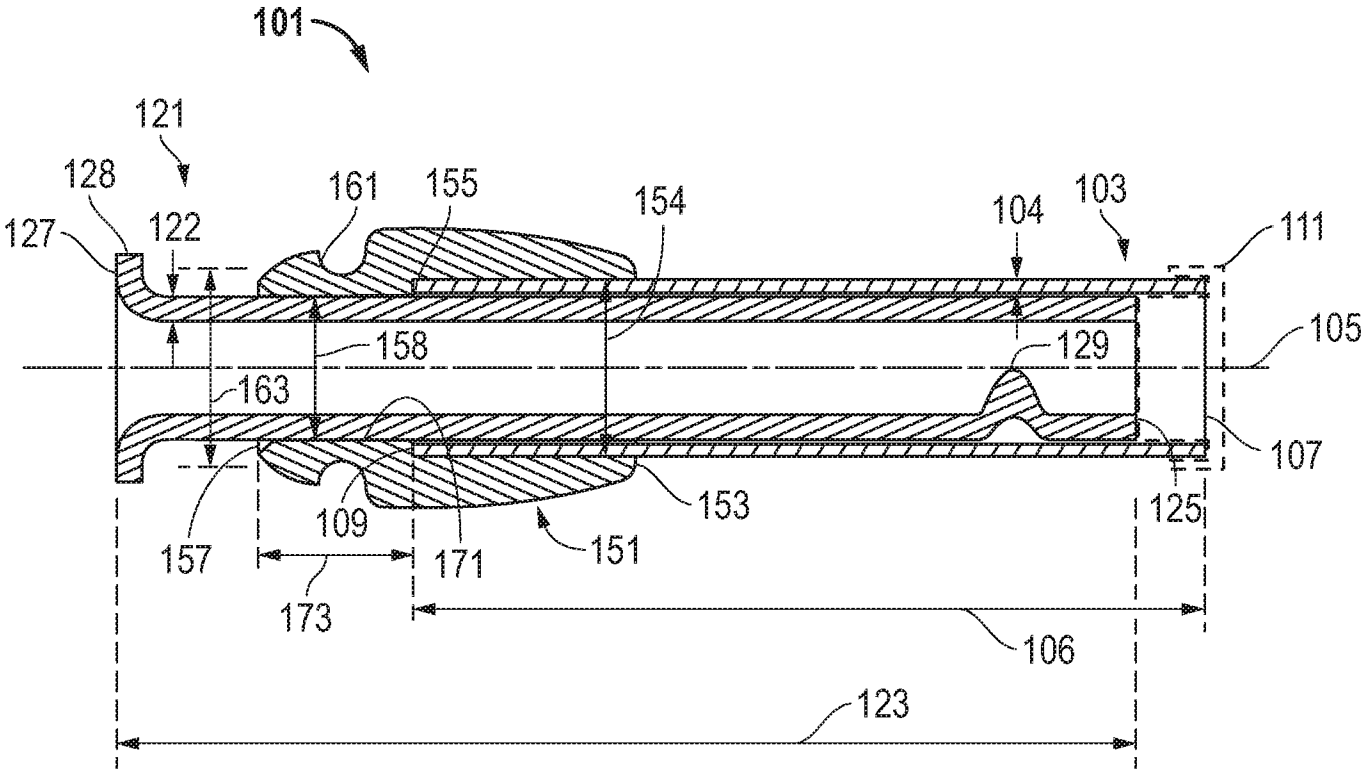
FIG. 9 is a sectional side view of an embodiment of the glass joint of FIG. 1.

FIGS. 1-9 depict embodiments of an apparatus 101 for smoking combustible material. Versions of the apparatus 101 can include a glass tube 103 having an axis 105 and open ends 107, 109. An optional cap or plug 111 (FIG. 9) can be configured to be mounted to the distal end 107 of the glass tube 103.

Examples of the apparatus 101 also can include a glass rod 121 configured to be axially coupled to the glass tube 103. The glass rod 121 can be configured as a glass plunger that is hollow and open on both ends 125, 127. In some versions, the glass tube 103 and the glass rod 121 can be formed from a same material, and can even consist of a same material. For example, the material used to form the glass tube 103 and the glass rod 121 can comprise borosilicate glass.

Embodiments of the apparatus 101 also can include a grommet 151 formed from an elastic material. For example, the elastic material of the grommet 151 can include an elastomer or silicone. Other versions of the grommet can have a selected material hardness. For example, the material can have a Shore 00 hardness in a range of about 30 to about 70. The glass tube 103, glass rod 121 and grommet 151 can be mounted together in a co-axial or substantially co-axially configuration.

Some versions of the grommet 151 can include a tube end 153 configured to axially receive the glass tube 103 in an interior of the grommet 151. For example, the grommet 151 can include a shoulder 155 in its interior adjacent the tube end 153. The shoulder 155 can be configured to abut one of the open ends 109 of the glass tube 103. Embodiments of the grommet 151 also can have a rod end 157 configured to receive and frictionally engage a portion of the glass rod 121. The rod end 157 can permit relative motion between the glass rod 121 and the grommet 151.

Embodiments of the grommet 151 can further include an external annular recess 161 located between the tube end 153 and the rod end 157. In some versions, an outer diameter 163 of the external annular recess 161 can be greater than or equal to an inner diameter 154 of the tube end 153. Examples of the outer diameter 163 of the external annular recess 161 can be greater than or equal to an inner diameter 158 of the rod end 157. In a version, the inner diameter 154 of the tube end 153 can be greater than the inner diameter 158 of the rod end 157.

Some embodiments of the grommet 151 can include a throat 171 extending from the rod end 157 to the shoulder 155 in the interior of the grommet 151. The throat 171 can have a throat axial length 173 that can be configured to be about 10% to about 20% of an overall axial length 123 of the rod 121.

Other versions of the apparatus 101 can include components with specific ranges of dimensions or ranges of selected ratios. Embodiments of the glass rod 121 can have a radial wall thickness 122 that is greater than a radial wall thickness 104 of the glass tube 103. For example, the radial wall thickness 122 of the glass rod 121 can be about 1 mm, and the radial wall thickness 104 of the glass tube 103 can be about 0.6 mm. The axial length 106 of the glass tube 103 can be about 50 mm, in one version.

In operation, the glass rod 121 can be configured to be both axially movable and rotationally movable about the axis 105 relative to the glass tube 103 and to the grommet 151, in some versions. Embodiments of the apparatus 101 can include a retracted position (e.g., FIG. 2) where distal ends 107, 125 of the glass tube 103 and glass rod 121, respectively, are configured to substantially axially align. Embodiments of the apparatus 101 also can include various extended positions (e.g., FIG. 1) wherein the distal ends 107, 125 are axially spaced apart from each other.

Embodiments of the glass rod 121 can include an interior having a divot 129 (e.g., a glass divot). The divot 129 can extend radially inward relative to the axis 105. The divot 129 can be located adjacent the distal end 125 of the glass rod 121. The divot 129 can include a conical shape, for example. In some versions, the proximal end 127 of the glass rod 121 can include a flare having a flange 128 that is substantially perpendicular perpendicular to the axis 105. The divot 129 can be configured to help push ash out of the glass tube 103 while using the apparatus 101 for smoking combustible material.

Figure 10:
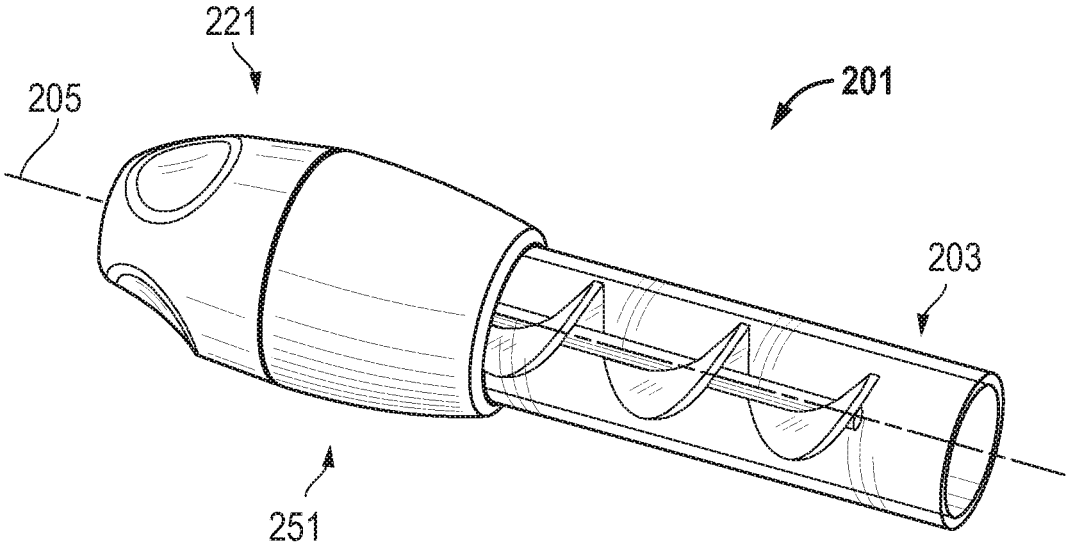
FIG. 10 is a perspective view of an embodiment of a glass joint with auger shown assembled.
Figure 11:
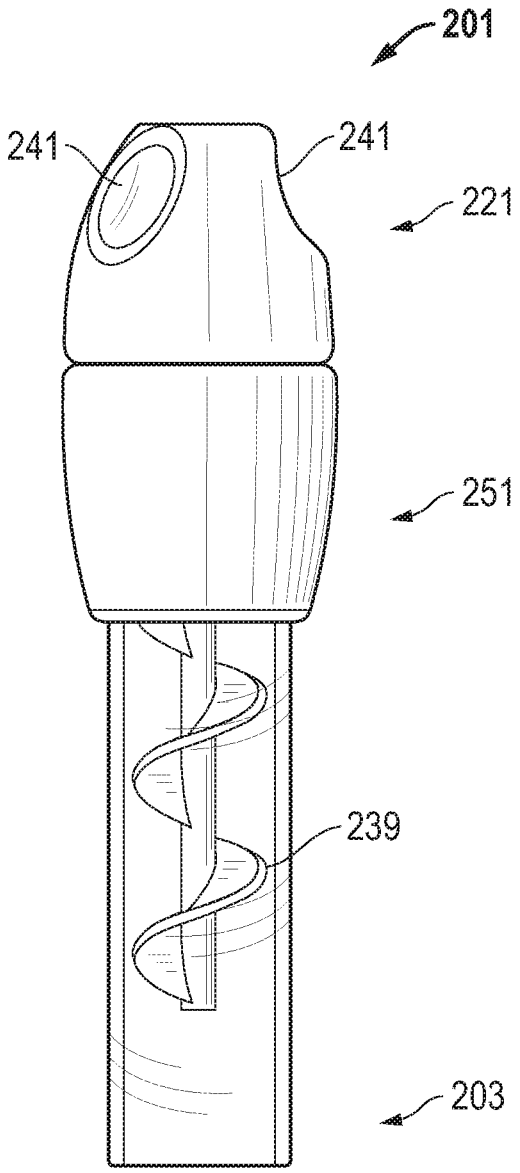
FIG. 11 is a right side view of an embodiment of the glass joint of FIG. 10.
Figure 12:
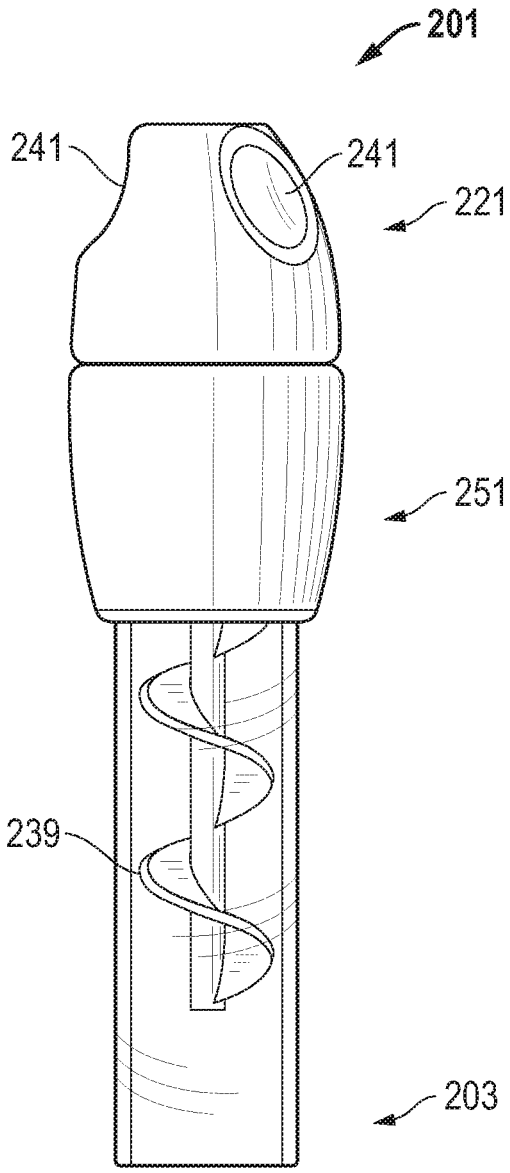
FIG. 12 is a left side view of an embodiment of the glass joint of FIG. 10.
Figure 13:
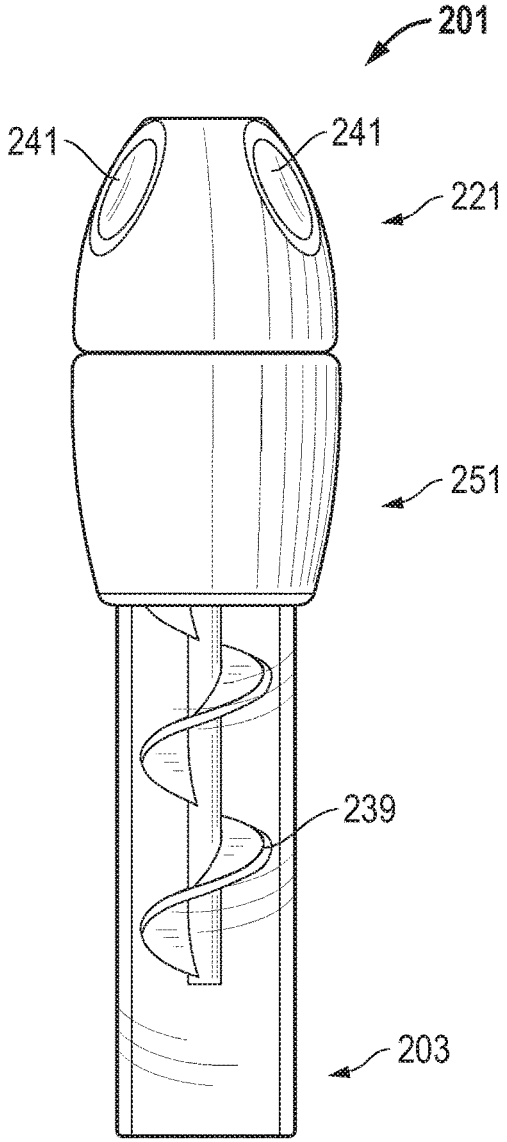
FIG. 13 is a top view thereof.
Figure 14:
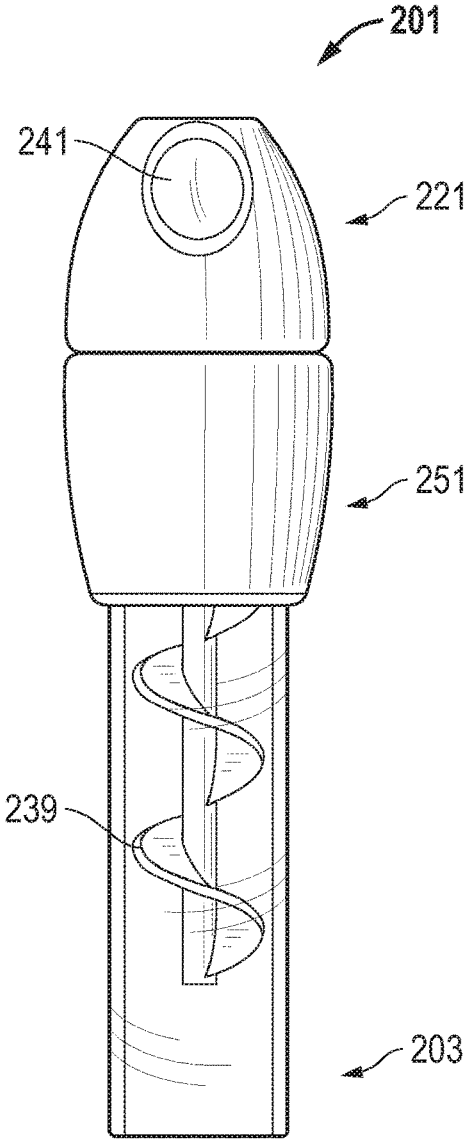
FIG. 14 is a bottom view thereof.
Figure 15:
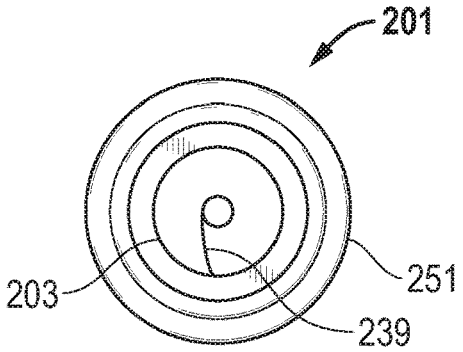
FIG. 15 is a rear view thereof.
Figure 16:
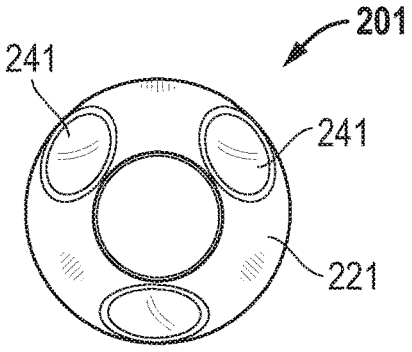
FIG. 16 is a front view thereof.
Figure 17:
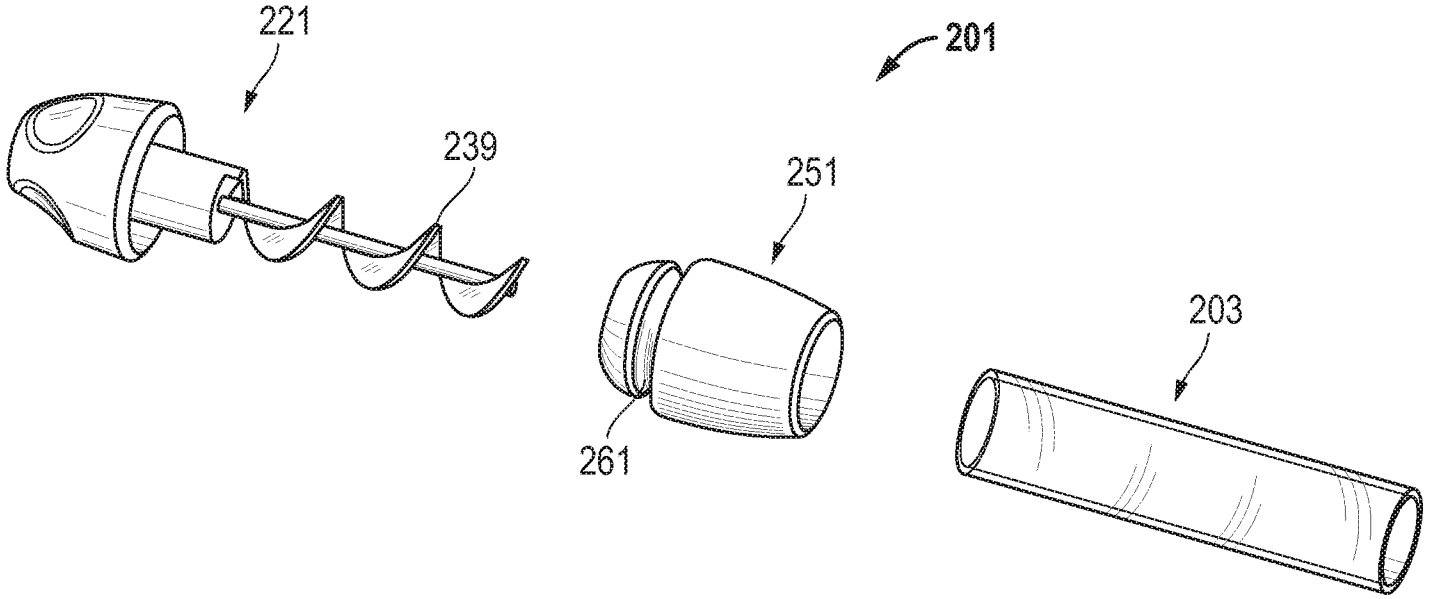
FIG. 17 is a perspective view of the glass joint with auger shown disassembled.
Figure 18:
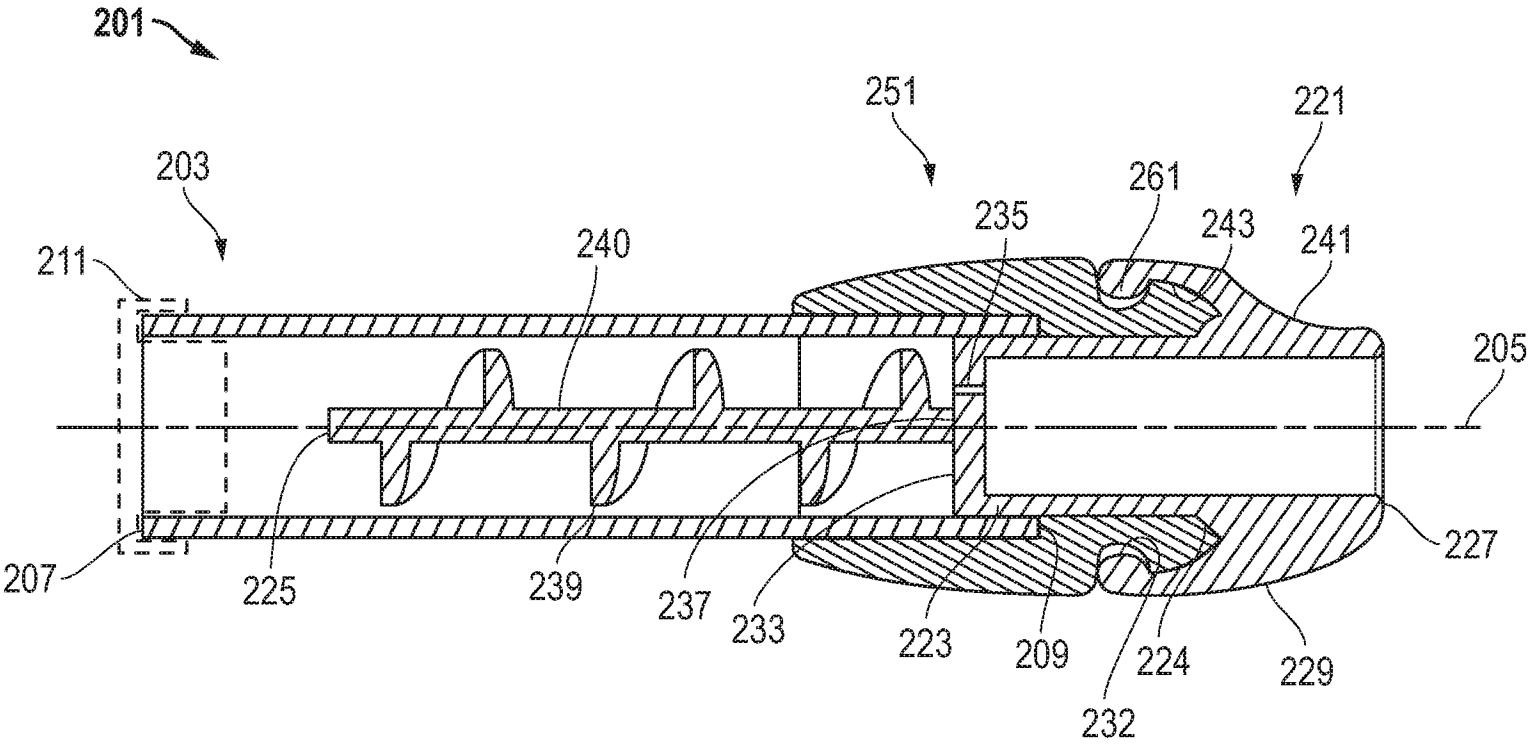
FIG. 18 is a sectional side view of an embodiment of the glass joint of FIG. 10.

FIGS. 10-18 depict embodiments of another type of apparatus 201 for smoking combustible material. Like other examples, shown and described herein, versions of the apparatus 201 can include a glass tube 203 having an axis 205 and open ends 207, 209. An optional plug 211 (FIG. 18) can be configured to be mounted to the distal end 207 of the glass tube 203.

Examples of the apparatus 201 also can include an auger assembly 221 configured to be axially coupled to the glass tube 203. The auger assembly 221 can be configured to have distal and proximal ends 225, 227. Embodiments of the apparatus 201 also can include a grommet 251 formed from an elastic material. For example, the elastic material of the grommet 251 can include an elastomer or silicone. The glass tube 203, auger assembly 221 and grommet 251 can be mounted together in a co-axial or substantially co-axially configuration.

Versions of the auger assembly 221 can include a body 223 having a mouthpiece 229 at the proximal end 225. In some embodiments, an auger 239 can be located opposite the mouthpiece 229. Embodiments of the auger 239 can be formed from a selected material such as ceramic, stainless steel or titanium. An end wall 233 can be positioned between the mouthpiece 229 and the auger 239. One or more holes 235 can be formed in the end wall 233 to permit fluid communication from the auger 239 through the end wall 233 to the mouthpiece 229, in some examples. In one version, four axial holes 235 can circumscribe a post of the auger 239.

Examples of the body 223 and the mouthpiece 229 can be hollow from the end wall 233 to a proximal end 237 of the auger 239. These components can include a consistent inner diameter in the hollow, in some versions. Embodiments of the auger 239 can include a single helix or flight that circumscribes the axis 205 for about 2 turns to about 4 turns.

In some embodiments, an exterior of the mouthpiece 229 can include a plurality of finger grips 241 that can be configured to facilitate rotation of the auger 239 within the grommet 251. In one example, there are exactly three finger grips 241 and they can be symmetrically spaced apart. Each finger grip 241 can include an independent concave surface in the exterior of the mouthpiece 229.

In operation, the auger assembly 221 can be configured to be rotationally movable about the axis 205 relative to the glass tube 203 and the grommet 251. In some versions, the auger assembly 221 may or may not be axially movable relative to the grommet 251, unless being disassembled.

Embodiments of the auger assembly 221 can include a void 243 located between an exterior proximal end 224 of the body 223 and an interior distal end 230 of the mouthpiece 229. The void 243 can be configured to be contoured to an exterior of the mouthpiece end of the grommet 251, such that an interior rim 232 of the mouthpiece 229 can be configured to seat in the external annular recess 261 in the grommet 251.

In some versions, the auger assembly 221 can include an axial post 240, and a flight of the auger 239 can extend from the axial post 240. In another version, the auger 239 of the auger assembly 221 does not comprise and does not extend from an axial post (not shown). The distal end 225 of the auger assembly 221 can be configured to be located inside the glass tube 203 and axially spaced apart from the distal end 207 of the glass tube 203 by a selected distance. For example, the selected distance can be in a range of about 1 mm to about 10 mm.

Other versions can include one or more of the following embodiments.

1. An apparatus for smoking combustible material, the apparatus comprising:

a glass tube having an axis and open ends;

a rod configured to be axially coupled to the glass tube; and a grommet formed from an elastic material and having a tube end configured to axially receive the glass tube in an interior of the grommet, a shoulder in the interior of the grommet configured to abut one of the open ends of the glass tube, the grommet also having a rod end configured to receive and frictionally engage a portion of the rod and permit relative motion between the rod and the grommet, the grommet further having an external annular recess located between the tube end and the rod end, an outer diameter of the external annular recess is greater than or equal to an inner diameter of the tube end, the outer diameter of the external annular recess is greater than or equal to an inner diameter of the rod end; and the inner diameter of the tube end is greater than the inner diameter of the rod end.

2. The apparatus of any of these embodiments, wherein the grommet comprises a throat extending from the rod end to the shoulder in the interior of the grommet, and a throat axial length is configured to be about 10% to about 20% of an overall axial length of the rod.

3. The apparatus of any of these embodiments, further comprising a plug configured to be mounted inside a distal end of the glass tube.

4. The apparatus of any of these embodiments, wherein the rod comprises a glass plunger that is hollow and open on both ends.

5. The apparatus of any of these embodiments, wherein the glass tube and the glass plunger consist of a same material.

6. The apparatus of any of these embodiments, wherein the glass plunger has a radial wall thickness that is greater than a radial wall thickness of the glass tube.

7. The apparatus of any of these embodiments wherein, in operation, the glass plunger is configured to be both axially movable and rotationally movable about the axis relative to the glass tube and to the grommet.

8. The apparatus of any of these embodiments, wherein the glass plunger has a retracted position where distal ends of the glass plunger and glass rod are configured to substantially axially align, and an extended position wherein the distal ends are axially spaced apart from each other.

9. The apparatus of any of these embodiments, wherein an interior of the glass plunger has a glass divot extending radially inward therefrom relative to the axis, and the divot is located adjacent a distal end of the glass plunger.

10. The apparatus of any of these embodiments, wherein a proximal end of the glass plunger comprises a flare having a flange that is substantially perpendicular to the axis.

11. The apparatus of any of these embodiments, wherein the rod comprises a body having a mouthpiece on one end, an auger opposite the mouthpiece, an end wall between the mouthpiece and the auger, and a hole in the end wall to permit fluid communication from the auger through the end wall to the mouthpiece.

12. The apparatus of any of these embodiments, wherein the body and mouthpiece are hollow from the end wall to a proximal end of the rod and comprise a consistent inner diameter in the hollow.

13. The apparatus of any of these embodiments, wherein the auger comprises a single helix that circumscribes the axis for about 2 to about 4 turns.

14. The apparatus of any of these embodiments, wherein an exterior of the mouthpiece comprises a plurality of finger grips configured to facilitate rotation of the rod within the grommet.

15. The apparatus of any of these embodiments, wherein there are exactly 3 finger grips that are symmetrically spaced apart, and each finger grip comprises an independent concave surface in the exterior of the mouthpiece.

16. The apparatus of any of these embodiments, wherein, in operation, the rod is configured to be rotationally movable about the axis relative to the glass tube and the grommet, but not axially movable.

17. The apparatus of any of these embodiments, wherein the rod comprises a void located between an exterior proximal end of the body and an interior distal end of the mouthpiece, and the void is configured to be contoured to an exterior of the rod end of the grommet, such that an interior rim of the mouthpiece is configured to seat in the external annular recess in the grommet.

18. The apparatus of any of these embodiments, wherein the auger comprises an axial post, and a flight of the auger extends from the axial post.

19. The apparatus of any of these embodiments, wherein the auger does not comprise and does not extend from an axial post.

20. The apparatus of any of these embodiments, wherein an axial end of the auger is configured to be located inside the glass tube and axially spaced apart from a distal end of the glass tube by a distance in a range of about 1 mm to about 10 mm.

This written description uses examples to disclose the embodiments, including the best mode, and also to enable those of ordinary skill in the art to make and use the invention. The patentable scope is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

Note that not all of the activities described above in the general description or the examples are required, that a portion of a specific activity may not be required, and that one or more further activities can be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

It can be advantageous to set forth definitions of certain words and phrases used throughout this patent document. The term "communicate," as well as derivatives thereof, encompasses both direct and indirect communication. The term "discreet," as well as derivatives thereof, references to the amount of skin exposed by a user of the garment, rather than the type of style of the garment. The terms "include" and "comprise," as well as derivatives thereof, mean inclusion without limitation. The term "or" is inclusive, meaning and/or. The phrase "associated with," as well as derivatives thereof, can mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items can be used, and only one item in the list can be needed. For example, "at least one of: A, B, and C" includes any of the following combinations: A, B, C, A and B, A and C, B and C, and A and B and C.

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

The description in the present application should not be read as implying that any particular element, step, or function is an essential or critical element that must be included in the claim scope. The scope of patented subject matter is defined only by the allowed claims. Moreover, none of the claims invokes 35 U.S.C. § 112(f) with respect to any of the appended claims or claim elements unless the exact words "means for" or "step for" are explicitly used in the particular claim, followed by a participle phrase identifying a function.

Benefits, other advantages, and solutions to problems have been described above with regard to specific embodiments. However, the benefits, advantages, solutions to problems, and any feature(s) that can cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, can also be provided in combination in a single embodiment. Conversely, various features that are, for brevity, described in the context of a single embodiment, can also be provided separately or in any subcombination. Further, references to values stated in ranges include each and every value within that range.

The above discussion is meant to be illustrative of the principles and various embodiments of the present invention. Numerous variations and modifications will become apparent to those skilled in the art once the above disclosure is fully appreciated. It is intended that the following claims be interpreted to embrace all such variations and modifications.

What is claimed is:

1. An apparatus for smoking combustible material, the apparatus comprising:

a glass tube having an axis and open ends;

a rod configured to be axially coupled to the glass tube, and the rod comprises a glass plunger that is hollow and open on both ends; and a grommet formed from an elastic material and having a tube end configured to axially receive the glass tube in an interior of the grommet, a shoulder in the interior of the grommet configured to abut one of the open ends of the glass tube, the grommet also having a rod end configured to receive and frictionally engage a portion of the rod and permit relative motion between the rod and the grommet, the grommet further having an external annular recess located between the tube end and the rod end, an outer diameter of the external annular recess is greater than or equal to an inner diameter of the tube end, the outer diameter of the external annular recess is greater than or equal to an inner diameter of the rod end; and the inner diameter of the tube end is greater than the inner diameter of the rod end.

2. The apparatus of claim 1, wherein the grommet comprises a throat extending from the rod end to the shoulder in the interior of the grommet, and a throat axial length is configured to be about 10% to about 20% of an overall axial length of the rod.

3. The apparatus of claim 1, wherein the opens ends of the glass tube include a proximal end and a distal end, further comprising a plug configured to be mounted inside the distal end of the glass tube.

4. The apparatus of claim 1, wherein the glass tube and the glass plunger consist of a same material.

5. The apparatus of claim 1, wherein the glass plunger has a radial wall thickness that is greater than a radial wall thickness of the glass tube.

6. The apparatus of claim 1 wherein, in operation, the glass plunger is configured to be both axially movable and rotationally movable about the axis relative to the glass tube and to the grommet.

7. The apparatus of claim 6, wherein the glass plunger has a retracted position where distal ends of the glass plunger and glass rod are configured to axially align, and an extended position wherein the distal ends are axially spaced apart from each other.

8. An apparatus for smoking combustible material, the apparatus comprising:

a glass tube having an axis and open ends;

a rod configured to be axially coupled to the glass tube; and a grommet formed from an elastic material and having a tube end configured to axially receive the glass tube in an interior of the grommet, a shoulder in the interior of the grommet configured to abut one of the open ends of the glass tube, the grommet also having a rod end configured to receive and frictionally engage a portion of the rod and permit relative motion between the rod and the grommet, the grommet further having an external annular recess located between the tube end and the rod end, an outer diameter of the external annular recess is greater than or equal to an inner diameter of the tube end, the outer diameter of the external annular recess is greater than or equal to an inner diameter of the rod end; and the inner diameter of the tube end is greater than the inner diameter of the rod end;

wherein the rod comprises a glass plunger that is hollow and open on both ends;

wherein an interior of the glass plunger has a glass divot extending radially inward therefrom relative to the axis, and the divot is located adjacent a distal end of the glass plunger.

9. The apparatus of claim 8, wherein a proximal end of the glass plunger comprises a flare having a flange that is perpendicular to the axis.

10. An apparatus for smoking combustible material, the apparatus comprising:

a tube having an axis and open ends including a proximal end and a distal end;

a plunger coaxial with and coupled to the tube, wherein the plunger is hollow and comprises a proximal open plunger end and a distal open plunger end, wherein the proximal open plunger end includes an arcuate flare that extends in a radial direction, the arcuate flare is rotationally symmetrical about the axis and terminates at a diameter that is greater than that of the distal open plunger end; and a grommet formed from an elastic material and having a first grommet end that axially receives the proximal end of the tube in an interior of the grommet, a shoulder in the interior of the grommet configured to abut the proximal end of the tube, the grommet also having a second grommet end that receives and frictionally engages a portion of the plunger and permits relative motion between the plunger and the grommet.

11. The apparatus of claim 10, wherein an interior of the plunger has a divot extending radially inward therefrom relative to the axis, and the divot is located adjacent the distal open plunger end of the plunger.

12. The apparatus of claim 10, wherein the plunger is a glass plunger and the tube is a glass tube.

13. The apparatus of claim 12, wherein the inner diameter of the first end of the grommet is greater than the inner diameter of the second end of the grommet.

14. The apparatus of claim 13, wherein the glass tube is disposed radially between the grommet and the glass plunger at the first end of the grommet.

15. The apparatus of claim 13, the inner diameter of the tube corresponds to the inner diameter of the second end of the grommet.

16. The apparatus of claim 13, wherein the grommet defines an external annular recess located between the first grommet end and the second grommet end, an outer diameter of the external annular recess is greater than or equal to an inner diameter of the first grommet end, and the outer diameter of the external annular recess is greater than or equal to an inner diameter of the second grommet end.

17. The apparatus of claim 13, wherein the glass plunger has a radial wall thickness that is greater than a radial wall thickness of the glass tube.

18. The apparatus of claim 12, wherein the grommet is radially adjacent a first axial portion of the glass plunger, and the proximal end of the glass tube is radially adjacent a second axial portion of the glass plunger.

19. The apparatus of claim 18, wherein the first axial portion is axially adjacent the second axial portion.

* * * * *